US010916201B2

(12) United States Patent
Zhang et al.

(10) Patent No.: US 10,916,201 B2
(45) Date of Patent: Feb. 9, 2021

(54) SCAN CIRCUIT, DISPLAY PANEL, AND DISPLAY DEVICE

(71) Applicant: Shanghai Tianma AM-OLED Co., Ltd, Shanghai (CN)

(72) Inventors: Mengmeng Zhang, Shanghai (CN); Xingyao Zhou, Shanghai (CN); Yue Li, Shanghai (CN); Shuai Yang, Shanghai (CN)

( * ) Notice: Subject to any disclaimer, the term of this patent is extended or adjusted under 35 U.S.C. 154(b) by 0 days.

(21) Appl. No.: 16/687,710

(22) Filed: Nov. 19, 2019

(65) Prior Publication Data

US 2020/0082765 A1 Mar. 12, 2020

(30) Foreign Application Priority Data

May 31, 2019 (CN) ..... 2019 1 0472212

(51) Int. Cl.
*G09G 3/3266* (2016.01)

(52) U.S. Cl.
CPC ... *G09G 3/3266* (2013.01); *G09G 2300/0819* (2013.01); *G09G 2310/0283* (2013.01); *G09G 2310/0286* (2013.01)

(58) Field of Classification Search
CPC ..... G09G 3/3266; G09G 2310/0286; G09G 3/3233; G09G 2300/0809; G09G 2310/0256; G09G 3/3258; G09G 2320/045; G09G 3/30–3266; G09G 2310/0283
See application file for complete search history.

(56) References Cited

U.S. PATENT DOCUMENTS

2005/0212446 A1* 9/2005 Eom ..... G09G 3/3266 315/169.3
2007/0229409 A1 10/2007 Shin
2014/0198136 A1* 7/2014 Lee ..... G09G 3/3233 345/690
2019/0287465 A1* 9/2019 Zhao ..... G09G 3/3225

FOREIGN PATENT DOCUMENTS

CN 1674074 A 9/2005
CN 101350179 A 1/2009
CN 102324224 A 1/2012
CN 102385835 A 3/2012
CN 104425034 A 3/2015
CN 108364611 A 8/2018

* cited by examiner

*Primary Examiner* — Sanjiv D. Patel
(74) *Attorney, Agent, or Firm* — Kilpatrick Townsend & Stockton, LLP

(57) ABSTRACT

A scan circuit, a display panel, and a display device are provided. The scan circuit includes a switch control circuit in addition to a gate driver circuit with forward and backward scan functions, where the switch control circuit is configured to transmit a second scan signal to a corresponding row of pixels, and a first scan signal to its next row of pixel in a scan direction when the gate driver circuit outputs a drive signal at each of the signal output terminals. In this way, no matter whether the gate driver circuit performs forward or backward scanning, the switch control circuit controls the gate driver circuit to transmit firstly the first scan signal and then the second scan signal to the corresponding row of pixels.

18 Claims, 15 Drawing Sheets

SCAN CIRCUIT, DISPLAY PANEL, AND DISPLAY DEVICE

CROSS-REFERENCES TO RELATED APPLICATION

This application claims priority to Chinese patent application No. 201910472212.2 filed on May 31, 2019, which is incorporated herein by reference in its entirety.

FIELD

The present disclosure relates to the field of display technologies, and particularly to a scan circuit, a display panel and a display device.

BACKGROUND

An Organic Light-Emitting Diode (OLED) has been widely applied to a display device due to its advantages of self-emission, a wide color gamut, high contrast, a light weight, a small thickness, etc.

In an OLED display panel, generally an OLED and a pixel circuit configured to drive the OLED are arranged in a pixel element. The pixel circuit is generally controlled using at least two different scan signal to drive the OLED to emit light, where the pixel circuit is initialized using one scan signal, and compensated using the other scan signal. For example, FIG. 1 illustrates a pixel circuit, which includes six switch transistors M1 to M6, a driver transistor M0, and a capacitor C, and FIG. 2 illustrates a corresponding input timing diagram of the pixel circuit, where Scan1' is configured to initialize the pixel circuit, and Scan2' is configured to compensate for the pixel circuit.

In the OLED display panel, Scan1' and Scan2' are generally output by a gate driver circuit as illustrated in FIG. 3, which includes cascaded shift register elements VSRn', and each other stage of shift register element VSRn' than the last stage of shift register element provides the scan signal Scan2' to a corresponding row of pixel elements Pixn', but also the scan signal Scan1' to the next row of pixel elements Pixn+1'.

In order to satisfy a demand for a diversity of products, the gate driver circuit with forward and backward scan functions may be required to perform forward and backward display functions on a screen. However the related gate driver circuit with the forward and backward scan functions in the OLED display panel can not perform the forward and backward display functions on the screen because while the gate driver circuit is scanning forward, the same row of pixel elements Pixn' firstly receive Scan1' provided by the shift register element VSRn−1' to initialize the pixel circuits, and then receive Scan2' provided by the shift register element VSRn' to compensate for the pixel circuits; and while the gate driver circuit is scanning backward, the same row of pixel elements Pixn' firstly receive Scan2' provided by the shift register element VSRn', and then receive Scan1' provided by the shift register element VSRn−1', so that the pixel circuits are firstly compensated for and then initialized, that is, data are written into the pixel circuits and then initialized, and if the display function is performed using the initialized data, then an image will be displayed at the respective pixel elements on the OLED display panel using the same data, so the image can not be displayed normally while the OLED display panel is being scanned backward.

SUMMARY

In view of this, embodiments of the disclosure provide a scan circuit, a display panel, and a display device to perform bidirectional scanning.

An embodiment of the disclosure provides a scan circuit including a switch control circuit, and a gate driver circuit with forward and backward scan functions, and the gate driver circuit includes signal output terminals, and each of the signal output terminals corresponds to one row of rows of pixels, and the gate driver circuit is configured to output a drive signal sequentially through the plurality of signal output terminals; and the switch control circuit is configured to transmit a second scan signal to a corresponding row of pixels, and a first scan signal to its next row of pixels in a scan direction the gate driver circuit outputs the drive signal at each of the signal output terminals.

Correspondingly an embodiment of the disclosure further provides a display panel including the scan circuit above according to the embodiment of the disclosure.

Correspondingly an embodiment of the disclosure further provides a display panel including the display panel above according to the embodiment of the disclosure.

DETAILED DESCRIPTION

Figure 1:
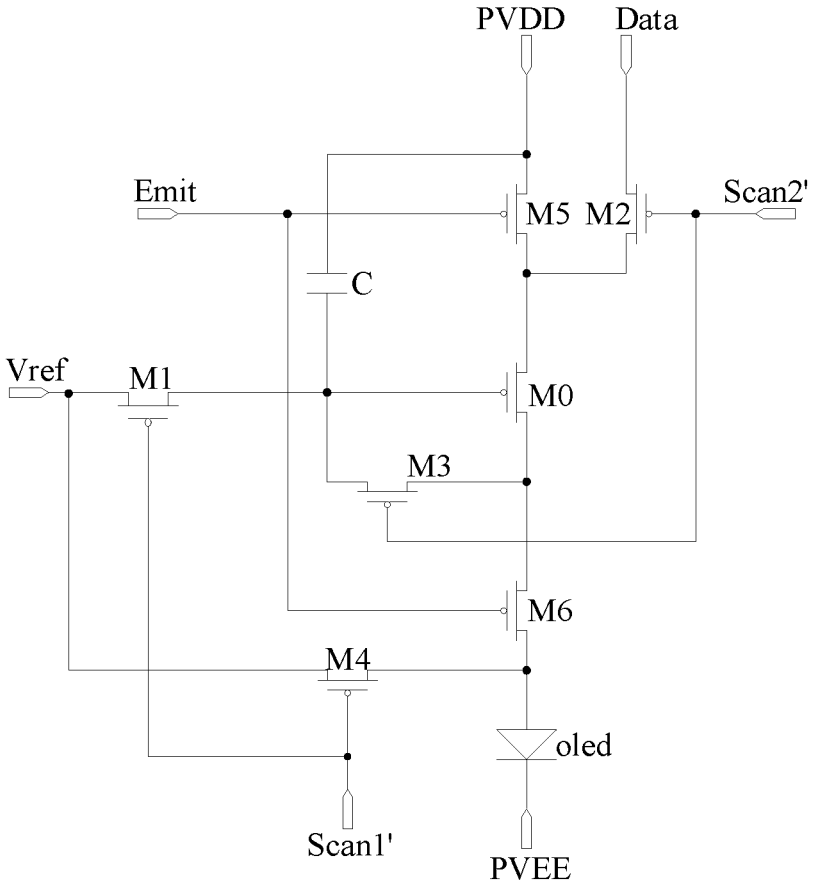
FIG. 1 is a schematic structural diagram of the pixel circuit in the related art.
Figure 2:
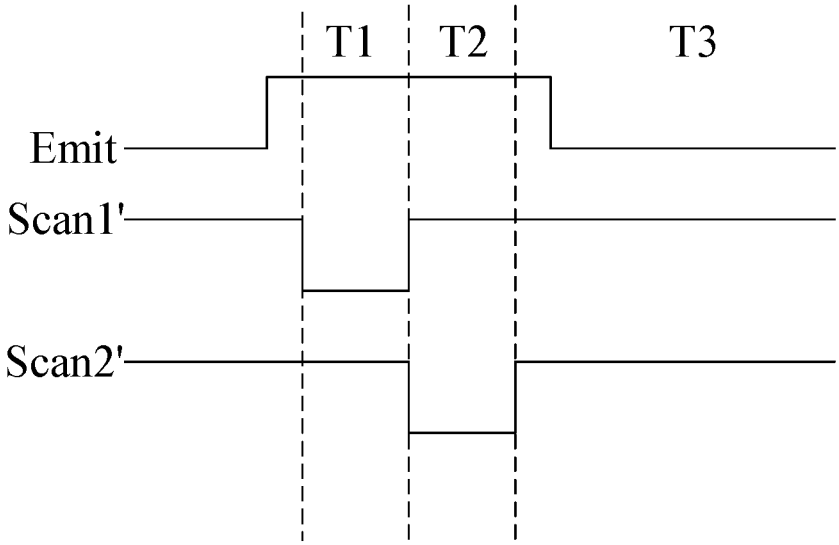
FIG. 2 is a timing diagram corresponding to the pixel circuit of FIG. 1.
Figure 3:
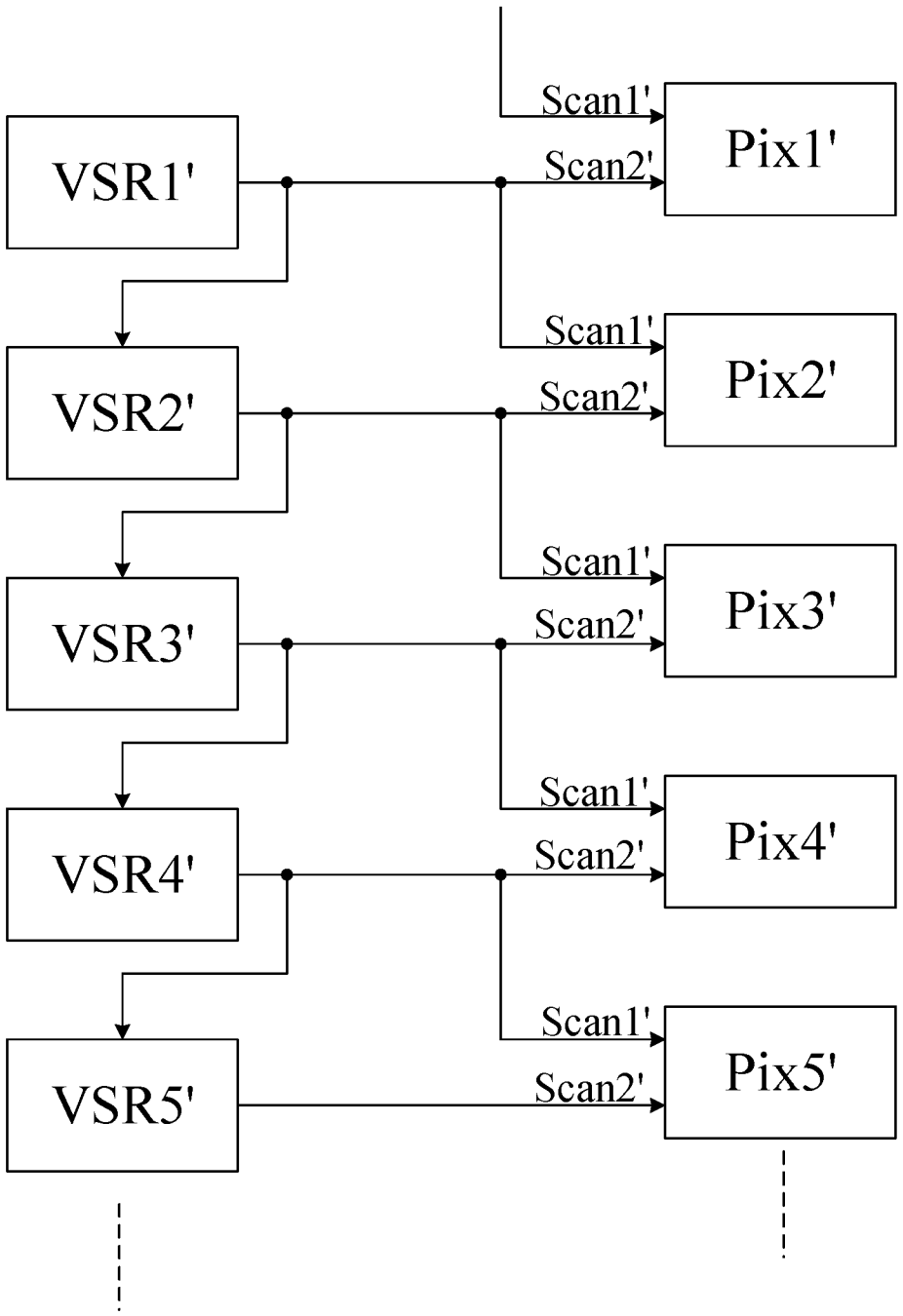
FIG. 3 is a schematic structural diagram of a gate driver circuit.

The embodiments of the disclosure provide a scan circuit, a display panel, and a display device. The disclosure will be described below in further details with reference to the drawings. Apparently the embodiments to be described are only a part but not all of the embodiments of the disclosure.

The shapes and sizes of respective components in the drawings are not intended to reflect any real proportion, but only intended to illustrate the disclosure.

Figure 4:
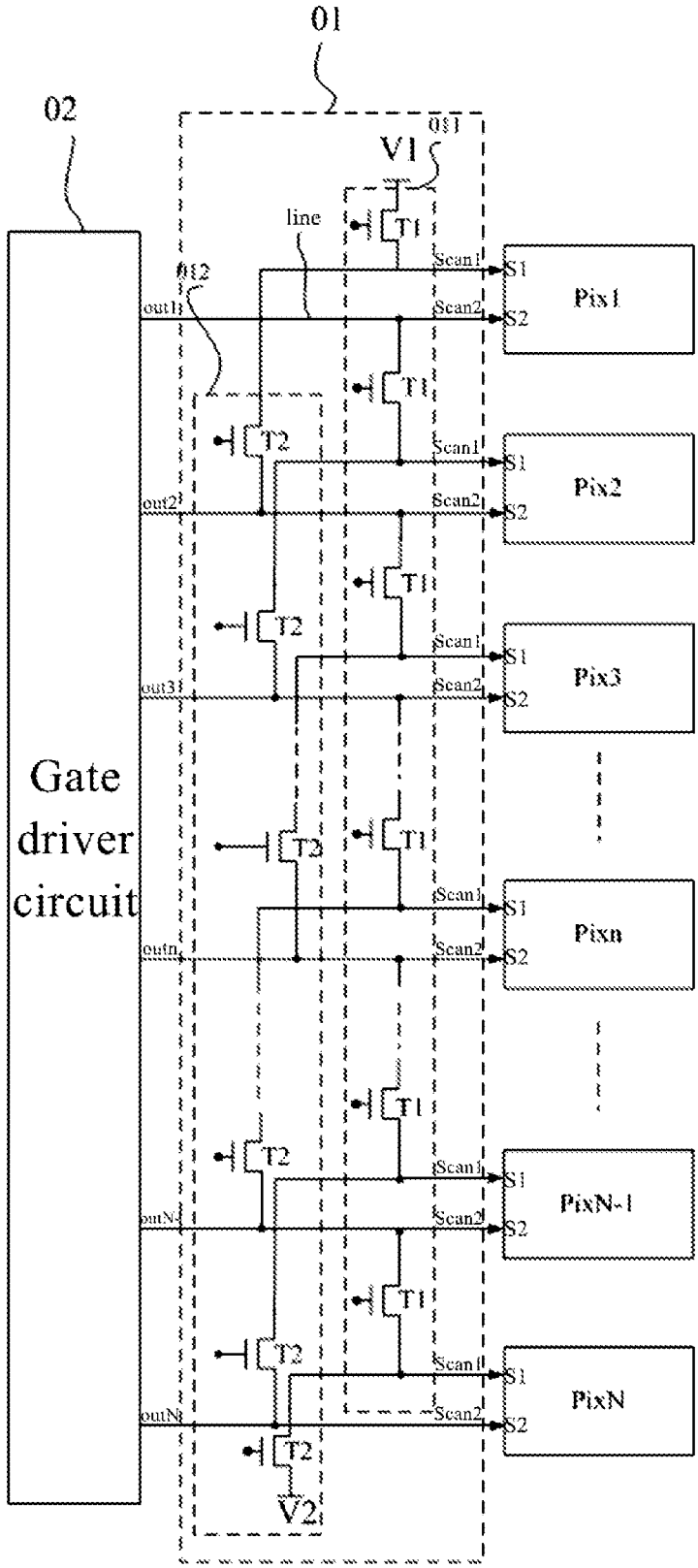
FIG. 4 is a schematic structural diagram of a scan circuit in accordance with an embodiment of the disclosure.

As illustrated in FIG. 4, a scan circuit according to an embodiment of the disclosure includes a switch control circuit 01, and a gate driver circuit 02 with forward and backward scan functions.

The gate driver circuit 02 includes signal output terminals (out1, out2, . . . , outn, . . . , outN), where each signal output terminal outn corresponds to a row of pixels (Pix1, Pix2, . . . , Pixn, . . . , PixN), and the gate driver circuit 02 outputs a drive signal sequentially through the plurality of signal output terminals outn.

The switch control circuit 01 is configured, when the gate driver circuit 02 output the drive signal at each signal output terminal outn, to transmit a second scan signal Scan2 to a corresponding row of pixels Pixn, and a first scan signal Scan1 to the next row of pixels Pixn+1 in a scan direction.

The scan circuit according to the embodiment of the disclosure includes a switch control circuit in addition to the gate driver circuit with the forward and backward scan functions, where the switch control circuit is configured to provide the second scan signal to the corresponding row of pixel, and the first scan signal to the next row of pixels in the scan direction when the drive signal is output at each signal output terminal of the gate driver circuit. In this way, no matter whether the gate driver circuit performs forward or backward scanning, the switch control circuit transmits firstly the first scan signal and then the second scan signal, that is, the row of pixels receives the first scan signal and the second scan signal at the fixed timing, so the same function can be performed for the row of pixels in both the forward scan direction and the backward scan direction. Accordingly in the embodiment of the disclosure, the scan circuit can be arranged to functionally perform bidirectional scanning on the display panel. In a specific implementation, in the forward scan direction, the first row of pixels corresponds to the first signal output terminal of the gate driver circuit, that is, there is no preceding signal output terminal, so an additional signal terminal shall be arranged externally; and in the backward scanning direction, the last row of pixels corresponds to the last signal output terminal of the gate driver circuit, and there is no next signal output terminal, so an additional signal terminal shall also be arranged externally.

Accordingly in the scan circuit according to the embodiment of the disclosure, as illustrated in FIG. 4, the switch control circuit 01 is further configured to transmit the first scan signal Scan1 to the first row of pixels Pix1 in the scan direction before the second scan signal Scan2 is transmitted thereto.

In one embodiment, in the scan circuit according to the embodiment of the disclosure, as illustrated in FIG. 4, for the same row of pixels, the switch control circuit 01 is configured to transmit the first scan signal Scan1 to the row of pixels Pixn before the second scan signal Scan2 is transmitted thereto, where the first scan signal Scan1 is configured to initialize the row of pixels Pixn, and the second scan signal Scan2 is configured to compensate for the row of pixels Pixn.

In the scan circuit above according to the embodiment of the disclosure, during forward scanning, the gate driver circuit outputs the drive signal sequentially in the forward direction, and when the drive signal is output at each of the signal output terminals of the gate driver circuit, the switch control circuit outputs the second scan signal to the corresponding row of pixels, and the first scan signal to the next row of pixels in the forward scan direction respectively, so that for the same row of pixels, the row of pixels firstly receive the first scan signal to be initialized, and then receive the second scan signal to be compensated for, so the respective rows of pixels are scanned forward. During backward scanning, the gate driver circuit outputs the drive signal sequentially in the backward direction, and when the drive signal is output at each of the signal output terminals of the gate driver circuit, the switch control circuit outputs the second scan signal to the corresponding row of pixels, and the first scan signal to the next row of pixels in the backward scan direction (i.e., the preceding row of pixels in the forward scan direction) respectively, so that for the same row of pixels, the row of pixels firstly receive the first scan signal to be initialized, and then receive the second scan signal to be compensated for, so the respective rows of pixels are scanned backward.

It shall be noted that in the embodiment of the disclosure, the scan signal refers to a pulse signal with an active level.

In one embodiment, in the scan circuit according to the embodiment of the disclosure, as illustrated in FIG. 4 to FIG. 8, the row of pixels Pixn includes a first control terminal S1 configured to receive the first scan signal Scan1, and a second control terminal S2 configured to receive the second scan signal Scan2.

The switch control circuit 01 includes a first switch control sub-circuit, a second switch control sub-circuit, and N wire lines, where N is the number of rows of pixels.

Each wire line corresponds to one of the signal output terminals outn, and the respective signal output terminals outn are connected with the second control terminals S2 of the corresponding rows of pixels Pixn through the corresponding wire lines. Sated otherwise, in the scan circuit according to the embodiment of the disclosure, each signal output terminal outn of the gate driver circuit 02 corresponds to one of the wire lines, different signal output terminals outn correspond to different wire lines, and the respective signal output terminals outn are connected with the second control terminals S2 of the corresponding rows of pixels Pixn through the corresponding wire lines, that is, the second scan signal Scan2 received by each row of pixels Pixn is the drive signal output by the corresponding signal output terminal outn.

Figure 5:
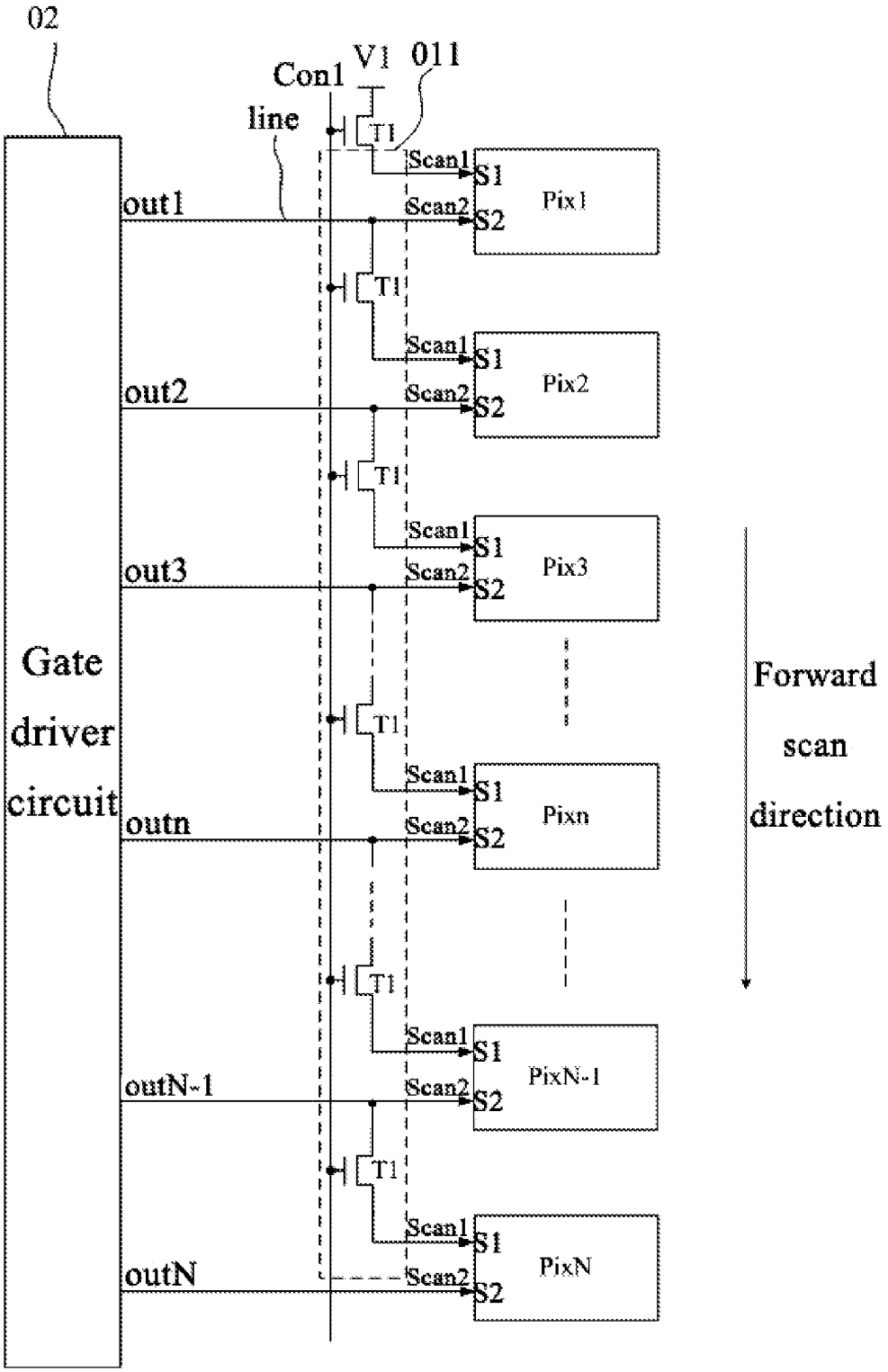
FIG. 5 is a schematic structural diagram of a first switch control sub-circuit in the scan circuit in accordance with the embodiment of the disclosure.

In one embodiment, as illustrated in FIG. 5, the first switch control sub-circuit includes: a first control device 011, a first control line Con1, and a first signal terminal V1. The first control device 011 is connected respectively with the first control line Con1, the first signal terminal V1, the respective signal output terminals outn, and the first control terminals S1 of the respective rows of pixels Pixn; and the first control device 011 is configured to connect the first control terminal S1 of the first row of pixels Pix1 in the forward scan direction with the first signal terminal V1, and to connect the first control terminals S1 of the other rows of pixels Pixn than the first row of pixels in the forward scan direction with their corresponding preceding signal output terminals outn−1, under the control of the first control line Con1. Stated otherwise, in the scan circuit according to the embodiment of the disclosure, the first control terminals S1 of the respective other rows of pixels Pixn than the first row of pixels Pix1 in the forward scan direction are connected with the preceding signal output terminals outn−1 in the forward scan direction through the first control device 011, that is, the first control device 011 makes the first scan signal Scan1 received by each other row of pixels Pixn be the drive signal output by the preceding signal output terminal outn−1 in the forward scan direction, under the control of the first control line Con1. The first row of pixels Pix1 receives the first scan signal Scan1 provided by the first signal terminal V1.

Figure 12:
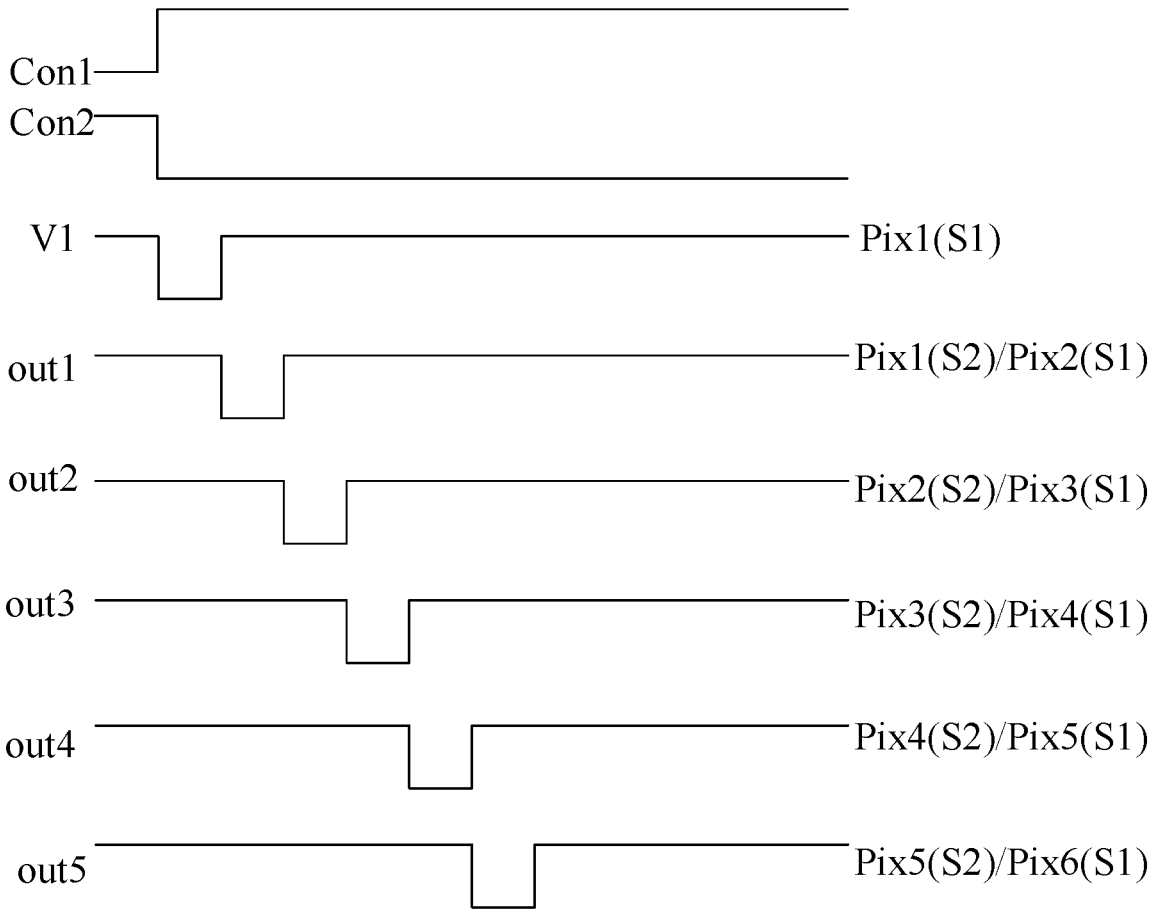
FIG. 12 is a forward scanning timing diagram corresponding to a scan circuit in accordance with an embodiment of the disclosure.

In one embodiment, in the scan circuit as illustrated above in FIG. 5 according to the embodiment of the disclosure, during forward scanning, FIG. 12 illustrates a corresponding timing diagram thereof, where the drive signal output by the signal output terminal outn corresponds to the second scan signal received at the second control terminal S2 of the corresponding row of pixels Pixn, and the first scan signal received at the first control terminal S1 of the next row of pixels Pixn+1 in the forward scan direction. Moreover for the first row of pixels Pix1 in the forward scan direction, the first control terminal S1 receives the signal provided by the first signal terminal V1 before the second control terminal S2 receives the drive signal output by the signal output terminal out1.

Figure 6:
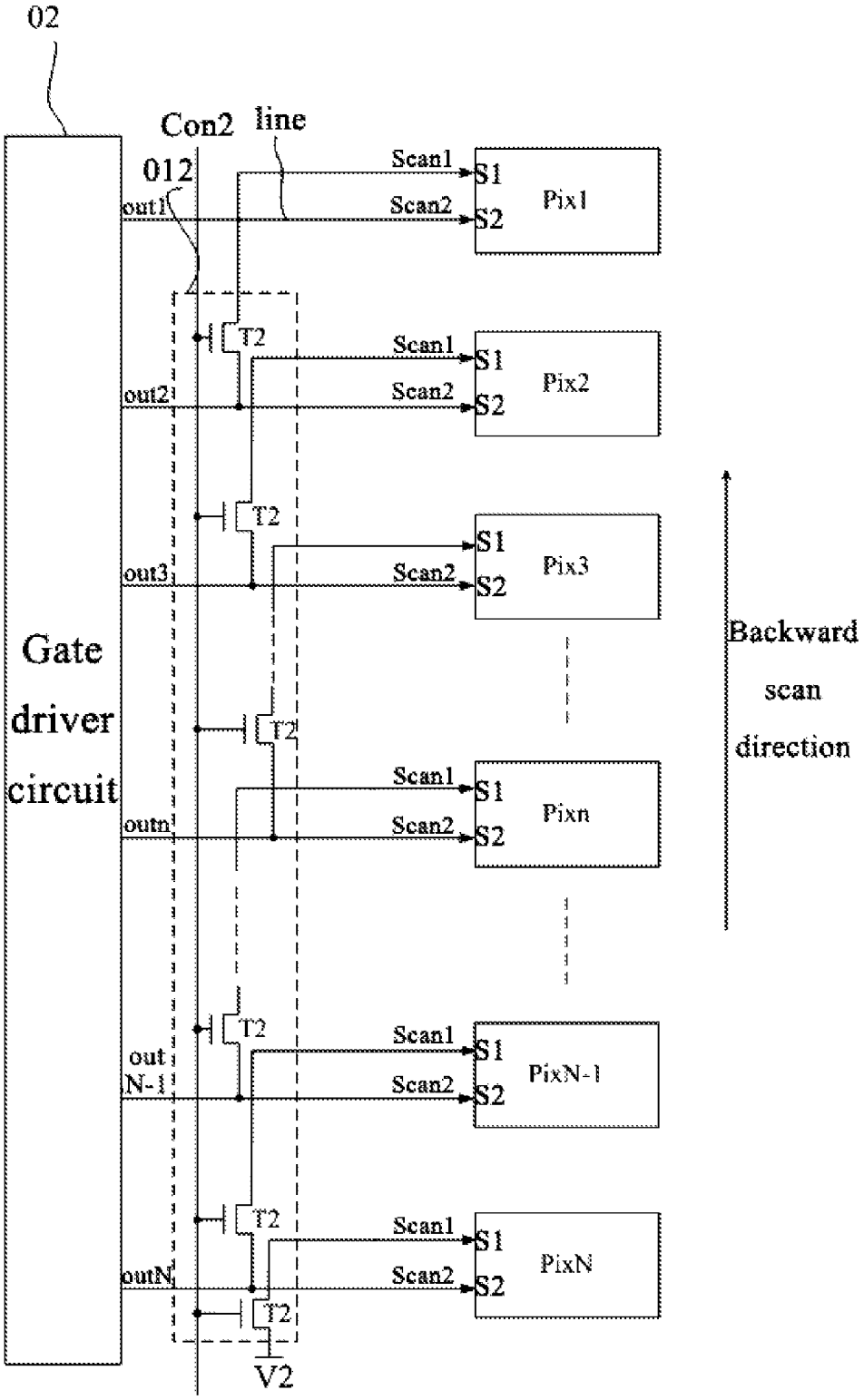
FIG. 6 is a schematic structural diagram of a second switch control sub-circuit in the scan circuit in accordance with the embodiment of the disclosure.
Figure 7:
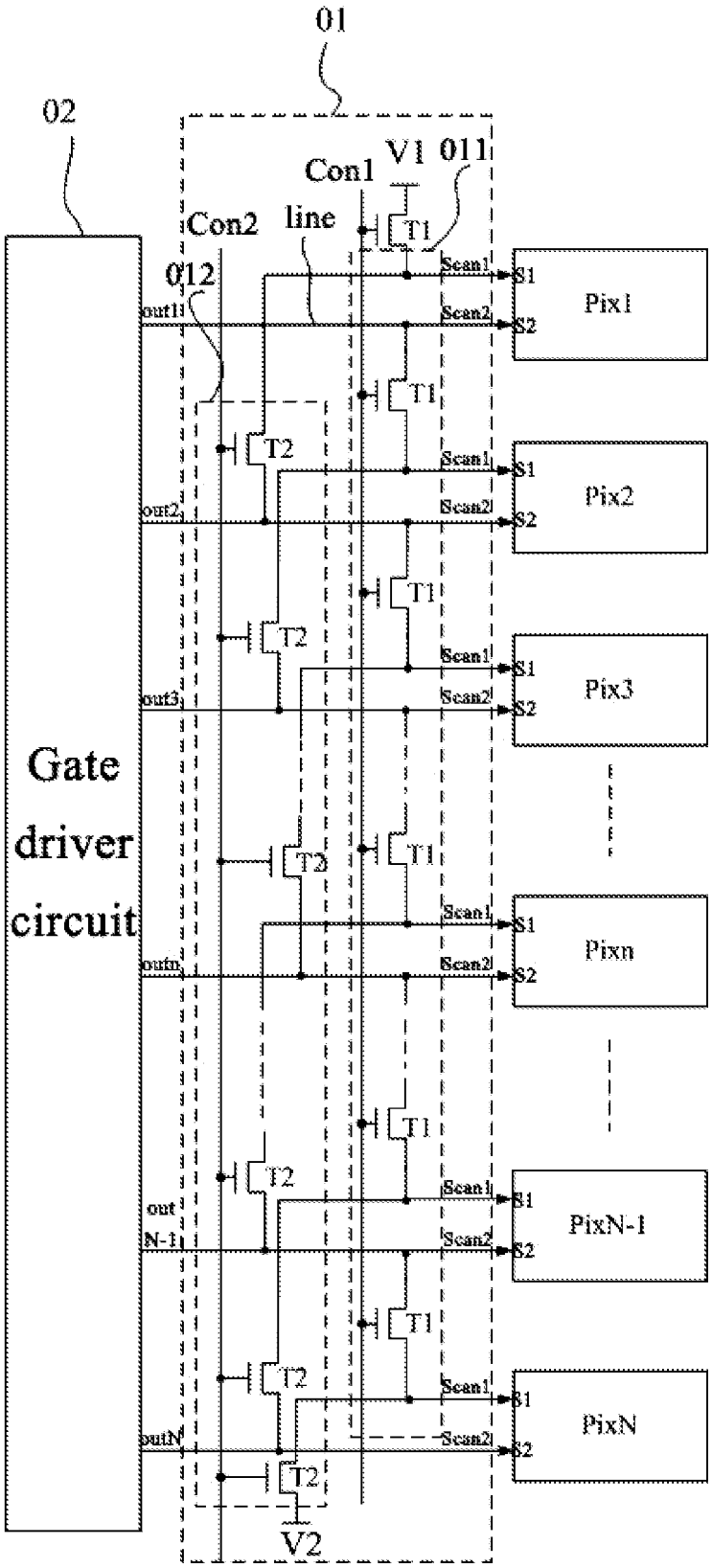
FIG. 7 is a schematic structural diagram of another scan circuit in accordance with an embodiment of the disclosure.

In one embodiment, as illustrated in FIG. 6, the second switch control circuit includes: a second control device 012, a second control line Con2, and a second signal terminal V2, where the second control device 012 is connected respectively with the second control line Con2, the second signal terminal V2, the respective signal output terminals outn, and the first control terminals S1 of the respective rows of pixels Pixn, where the second control device 012 is configured to connect the first control terminal S1 of the first row of pixels PixN in the backward scan direction with the second signal terminal V2, and to connect the first control terminals S1 of the other rows of pixels Pixn than the first row of pixels in the backward scan direction with their corresponding preceding signal output terminals outn+1, under the control of the second control line Con2. Stated otherwise, in the scan circuit according to the embodiment of the disclosure, the first control terminals S1 of the respective other rows of pixels Pixn than the first row of pixels PixN in the backward scan direction are connected with the preceding signal output terminals outn+1 in the backward scan direction through the second control device 012, that is, the second control device 012 makes the first scan signal Scan' received by each other row of pixels Pixn be the drive signal output by the preceding signal output terminal outn+1 in the backward scan direction, under the control of the second control line Con2. The first row of pixels PixN in the backward scan direction receives the first scan signal Scan1 provided by the second signal terminal V2.

Figure 13:
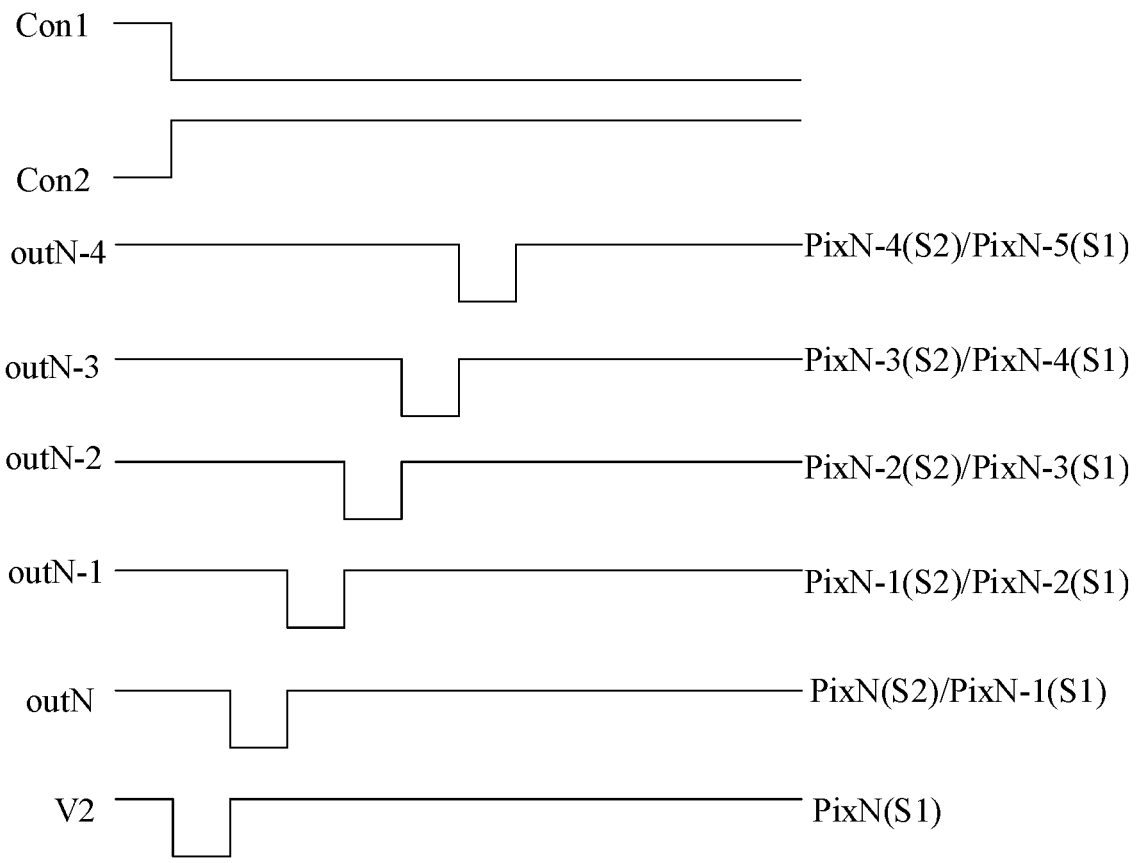
FIG. 13 is a backward scanning timing diagram corresponding to the scan circuit in accordance with an embodiment of the disclosure.

In one embodiment, in the scan circuit as illustrated above in FIG. 6 according to the embodiment of the disclosure, during backward scanning, FIG. 13 illustrates a corresponding timing diagram thereof, where the drive signal output by the signal output terminal outn corresponds to the second scan signal received at the second control terminal S2 of the corresponding row of pixels Pixn, and the first scan signal received at the first control terminal S1 of the next row of pixels Pixn−1 in the backward scan direction. Moreover for the first row of pixels PixN in the backward scan direction, the first control terminal S1 receives the signal provided by the second signal terminal V2 before the second control terminal S2 receives the drive signal output at the signal output terminal outN.

In one embodiment, in the scan circuit according to the embodiment of the disclosure, as illustrated in FIG. 4 to FIG. 6, the first control device 011 includes N first switch transistors T1, where the n-th one of the first switch transistors T1 corresponds to the n-th row of pixels Pixn in the forward scan direction, n is any integer from 1 to N, and N is the number of rows of pixels.

The first one of the first switch transistors T1 has a first electrode connected with the first signal terminal V1, and the others of the first switch transistors T1 than the first one have first electrodes connected with their preceding signal output terminals outn−1 in the forward scan direction.

The respective first switch transistors T1 have gates connected with the first control line Con1, and second electrodes connected with the second control terminals S2 of the corresponding rows of pixels Pixn.

While the gate driver circuit is scanning forward, the first control line Con1 controls the respective first switch transistors T1 to be turned on so that the first control terminal S1 of the first row of pixels Pix1 in the forward scan direction is connected with the first signal terminal V1, and the first control terminals S1 of the other rows of pixels Pixn in the forward scan direction are connected with the preceding signal output terminals outn−1 in the forward scan direction.

In one embodiment, in the scan circuit according to the embodiment of the disclosure, as illustrated in FIG. 4 to FIG. 8, the second control device 012 includes N second switch transistors T2, where the n-th one of the second switch transistors T2 corresponds to the n-th row of pixels PixN+1-n in the backward scan direction.

The first one of the second switch transistors T2 has a first electrode connected with the second signal terminal V2, and the others of the second switch transistors T2 than the first one have first electrodes connected with their preceding signal output terminals outn+1 in the backward scan direction.

The respective second switch transistors T2 have gates connected with the second control line Con2, and second electrodes connected with the second control terminals S2 of their corresponding rows of pixels Pixn.

While the gate driver circuit is scanning backward, the second control line Con2 controls the respective second switch transistors T2 to be turned on so that the second control terminal S2 of the first row of pixels PixN in the backward scan direction is connected with the second signal terminal V2, and the second control terminals S2 of the other rows of pixels Pixn in the backward scan direction are connected with the preceding signal output terminals outn+1 in the backward scan direction.

The specific structure of the second control device in the scan circuit has been described above only by way of an example, and in a specific implementation, the specific structure of the second control device will not be limited to the structure above according to the embodiment of the disclosure, but can alternatively be another structure, and the embodiment of the disclosure will not be limited thereto.

In one embodiment, in the scan circuit according to the embodiment of the disclosure, both the first switch transistors T1 and the second switch transistors T2 are N-type transistors, or both the first switch transistors T1 and the second switch transistors T2 are P-type transistors, so that the first switch transistors and the second switch transistors can be formed in the same process to simplify a process flow to lower a production cost.

Figure 8:
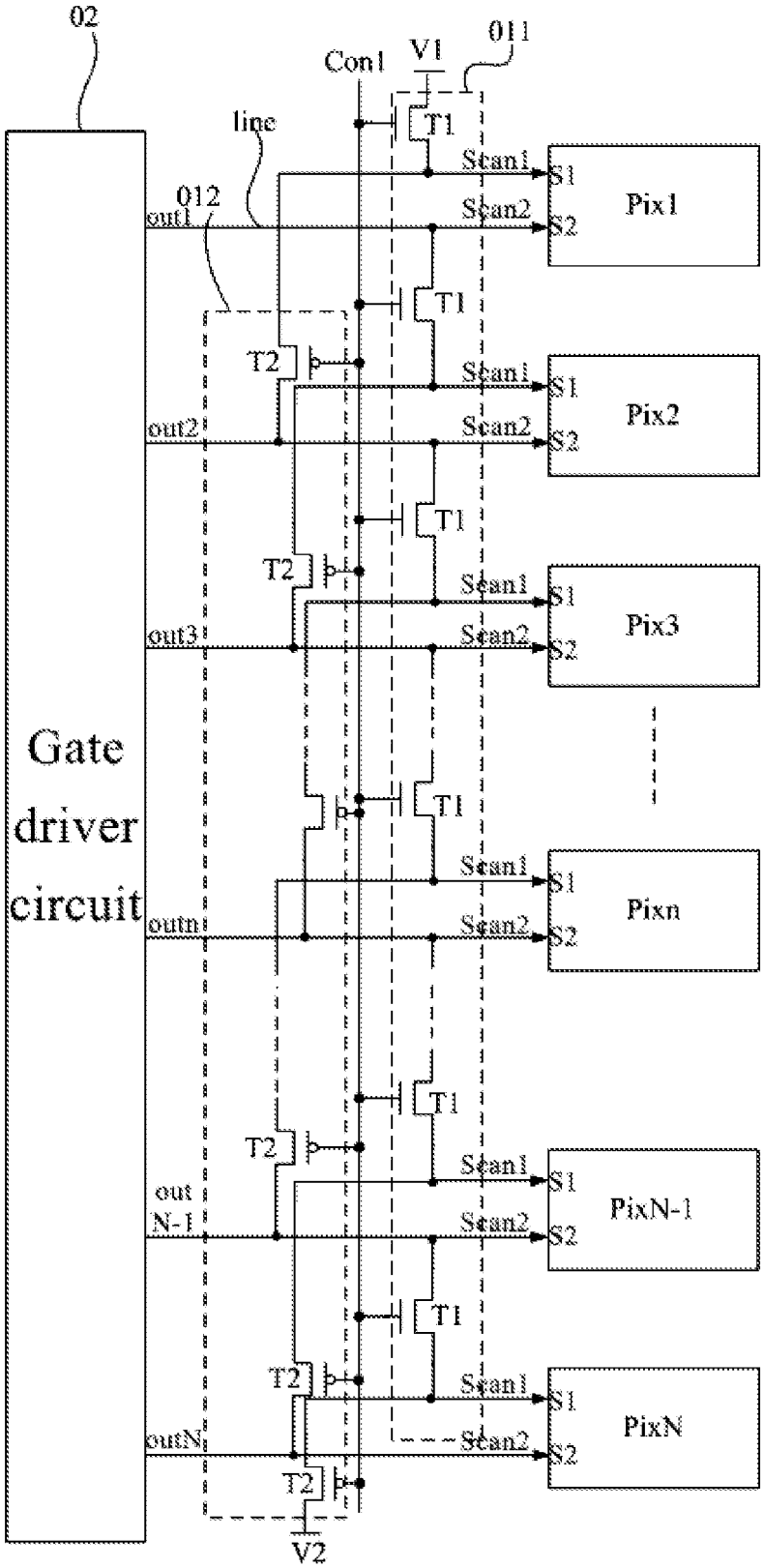
FIG. 8 is a schematic structural diagram of another scan circuit in accordance with an embodiment of the disclosure.

Of course, in the scan circuit according to the embodiment of the disclosure, the first switch transistors T1 can be N-type transistors, and the second switch transistors T2 can be P-type transistors; or the first switch transistors T1 can be P-type transistors, and the second switch transistors T2 can be N-type transistors. As illustrated in FIG. 8, for example, the first switch transistors T1 are N-type transistors, and the second switch transistors T2 are P-type transistors, so when a high-level signal is transmitted on the first control line Con1, the N-type first switch transistors T1 are turned on, and the P-type second switch transistors T2 are turned off, and when a low-level signal is transmitted on the first control line Con1, the P-type first switch transistors T1 are turned on, and the N-type second switch transistors T2 are turned off. Here the signal output on the first control line Con1, and the types of the transistors will not be limited thereto.

Furthermore in the scan circuit according to the embodiment of the disclosure, when one of the first switch transistor T1 and the second switch transistor T2 is N-type transistor, and the other is P-type transistor, and as illustrated in FIG. 8, for example, the first switch transistors T1 are N-type transistors, and the second switch transistors T2 are P-type transistors, the first control line Con1 is the same signal line as the second control line, so when a low-level signal is transmitted on the first control line and the second control line, the first switch transistors T1 are turned off, and the second switch transistors T2 are turned on, so that the first control line Con1 is the same signal line as the second control line, and only the first switch transistors T1 or the second switch transistors T2 are turned on at a time to perform a forward scan and display function and a backward scan and display function respectively. Accordingly the first control line Con1 is the same control line as the second control line so that one control signal can be dispensed with to narrow a bezel of the display panel in width.

In one embodiment, in the scan circuit according to the embodiment of the disclosure, the switch control circuit is further configured to output a third scan signal to the after next row of pixels in the scan direction when the drive signal is output at each of the signal output terminals of the gate driver circuit.

For the same row of pixels, the switch control circuit is configured to transmit the first scan signal to the row of pixels before the second scan signal is transmitted thereto, and to transmit the third scan signal to the row of pixels before the first scan signal is transmitted thereto.

Figure 9:
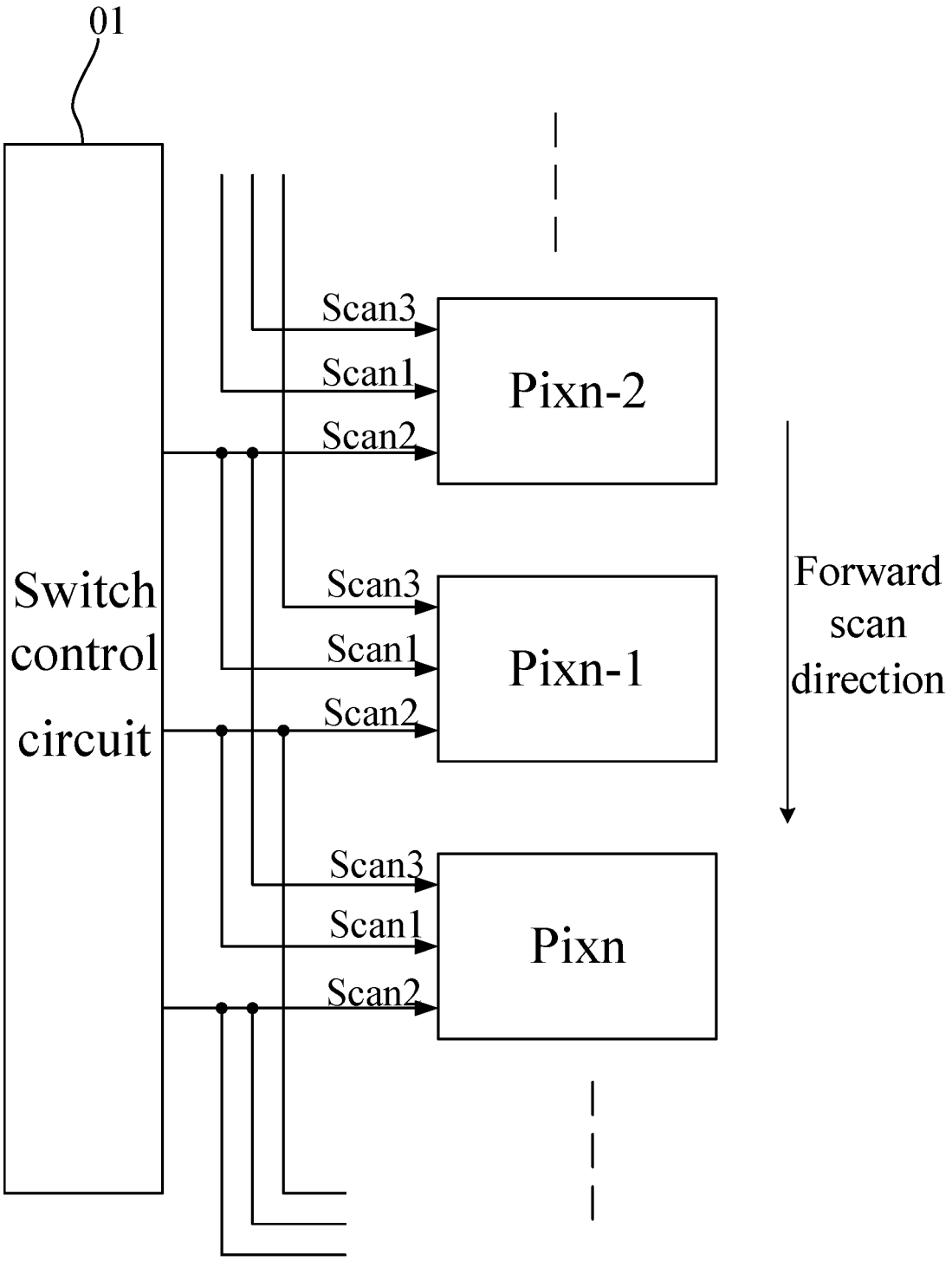
FIG. 9 is a schematic partial structural diagram of the other scan circuit in accordance with an embodiment of the disclosure.
Figure 10:
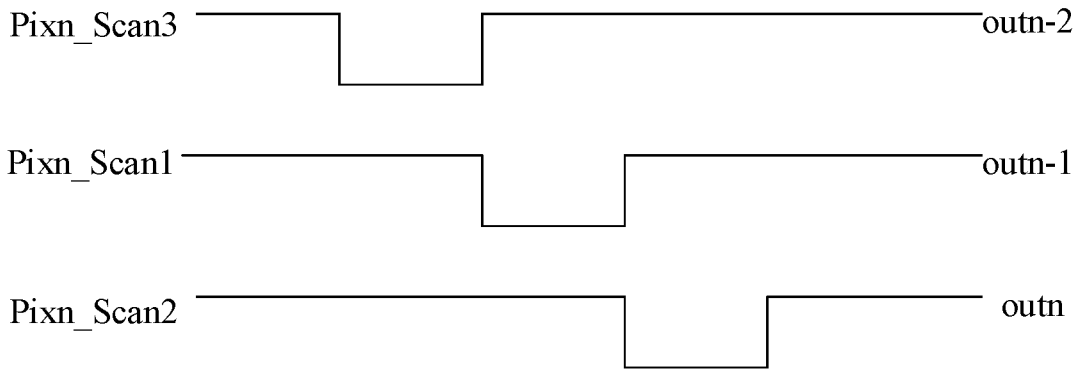
FIG. 10 is a timing diagram corresponding to the scan circuit of in FIG. 9.

In one embodiment, in the scan circuit according to the embodiment of the disclosure, as illustrated in FIG. 9, the switch control circuit 01 is configured to transmit the second scan signal Scan2 to the corresponding row of pixels Pixn, the first scan signal Scan1 to the next row of pixels Pixn+1 in the scan direction (e.g., the forward scan direction as illustrated in FIG. 8), and the third scan signal Scan3 to the after next row of pixels Pixn+2 in the scan direction respectively when the drive signal is output at each of the signal output terminals outn of the gate driver circuit. Stated otherwise, for the same row of pixels Pixn, as illustrated in FIG. 10, the switch control circuit is configured to transmit the first scan signal Scan1 to the row of pixels Pixn before the second scan signal Scan2 is transmitted thereto, and to transmit the third scan signal Scan3 to the row of pixels Pixn before the first scan signal Scan1 is transmitted thereto. When the n-th row of pixels Pixn receives the second scan signal Scan2, the corresponding signal output terminal outn outputs the drive signal, when the n-th row of pixels Pixn receives the first scan signal Scan1, the preceding signal output terminal outn−1 in the scan direction outputs the drive signal, and when the n-th row of pixels Pixn receives the third scan signal Scan3, the further preceding signal output terminal outn−2 in the scan direction outputs the drive signal.

Furthermore in the scan circuit according to the embodiment of the disclosure, the switch control circuit is further configured to transmit the (n+1)-th scan signal to the n-th rows of pixels succeeding to the current rows of pixels in the scan direction when the drive signal is output at the respective signal output terminal of the gate driver circuit, where n is a positive integer equal to or more than 3.

For the same row of pixels, the switch control circuit is configured to transmit the n-th scan signal to the row of pixel before the (n+1)-th scan signal is transmitted thereto.

In a specific implementation, the switch control circuit transmits the scan signals to rows of pixels concurrently under the same principle for the switch control circuit to transmit the scan signals to two rows of pixels concurrently in the embodiment above of the disclosure, so for an implementation in which the switch control circuit transmits the scan signals to rows of pixels concurrently, reference can be made to the implementation in which the switch control circuit transmits the scan signals to two rows of pixels concurrently in the embodiment above of the disclosure, and a repeated description thereof will be omitted here.

Figure 11:
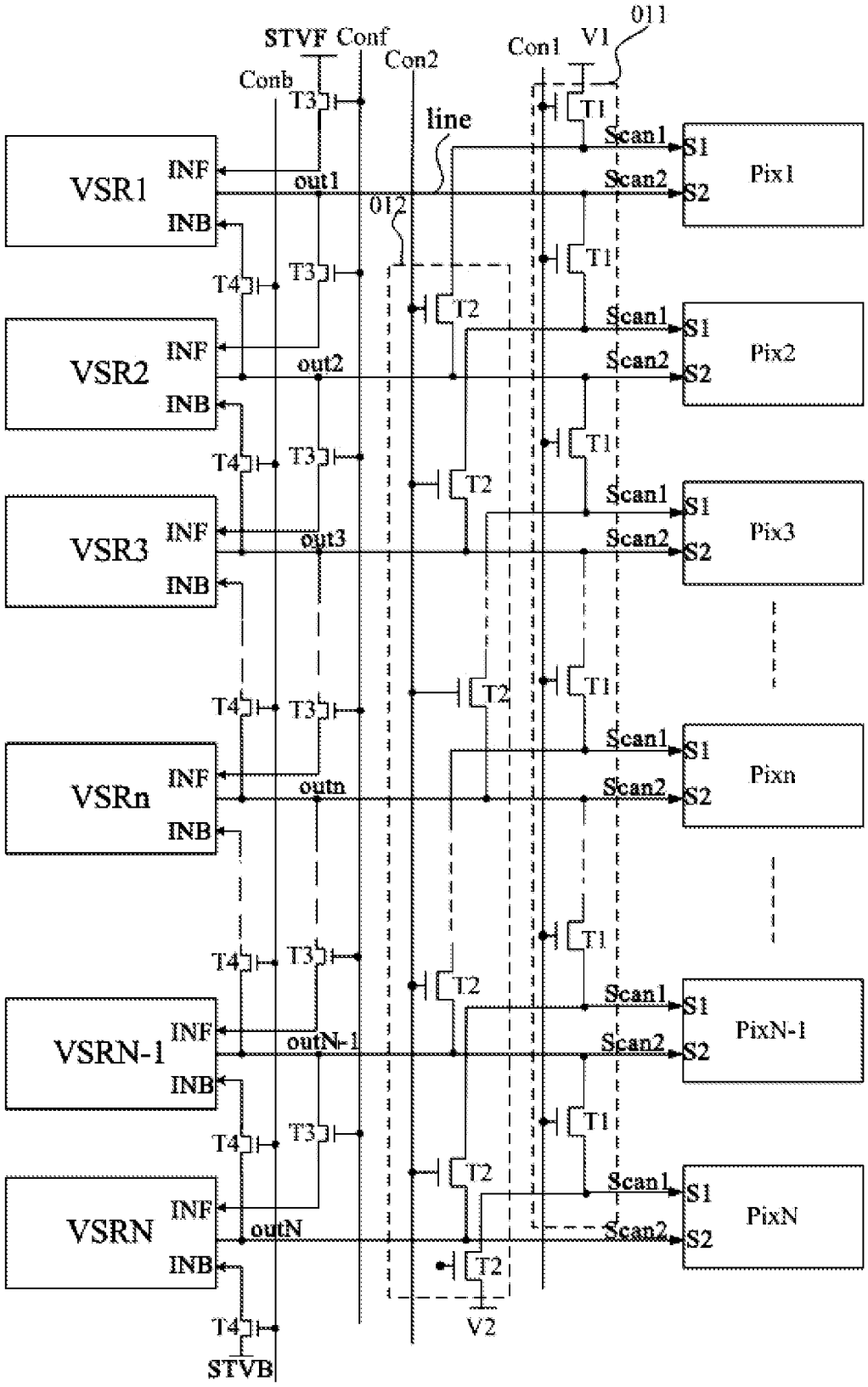
FIG. 11 is a schematic structural diagram of a further scan circuit according to an embodiment of the disclosure.

In one embodiment, in the scan circuit according to the embodiment of the disclosure, as illustrated in FIG. 11, the gate driver circuit includes cascaded shift register elements VSRn, each of which corresponds to one of the signal output terminals outn.

A forward input terminal INF of the first-stage shift register element VSR1 in the forward scan direction is connected with a forward scan frame trigger terminal STVF, and forward input terminals INF of the other-stage shift register element VSRn than the first-stage shift register element VSR1 is connected respectively with the signal output terminal outn−1 corresponding to its preceding shift register element VSRn−1 in the forward scan direction.

A backward input terminal INB of the last-stage shift register element VSRN in the forward scan direction is connected with a backward scan frame trigger terminal STVB, and backward input terminal INB of the other-stage shift register element VSRn than the last-stage shift register element VSRN is connected with the signal output terminal outn+1 corresponding to its preceding stage shift register element VSRn+1 in the backward scan direction.

In a specific implementation, in order to guarantee a display quality, the first row of pixels (in the forward scan direction) generally only receive a scan signal but do not display any image, so they are dummy pixels, and accordingly the first shift register element in the gate driver circuit is also a dummy shift register element. Of course, the row of dummy pixels may in one embodiment be not arranged in the display panel, so an image can be displayed starting with the first row of pixels.

In one embodiment, in the scan circuit according to the embodiment of the disclosure, the gate driver circuit further includes a forward scan control circuit and a backward scan control circuit.

The forward scan control circuit includes forward scan switch transistors T3 and a forward scan control line Conf, where each of the forward scan switch transistors T3 has a gate connected with the forward scan control line Conf, and the forward scan switch transistors T3 are configured to control the respective shift register elements VSR1 to VSRN to output the drive signal sequentially in the forward scan direction, under the control of the forward scan control line Conf.

The backward scan control circuit includes backward scan switch transistors T4 and a backward scan control line Conb, the backward scan switch transistors T4 are configured to control the shift register elements VSR1 to VSRN to output the drive signal sequentially in the backward scan direction, under the control of the backward scan control line Conb.

In a specific implementation, when the forward scan control line controls the forward scan switch transistors to be turned on, the respective shift register elements in the gate driver circuit output the drive signal sequentially in the forward scan direction, and the first control line controls the respective first switch transistors in the first control device to be turned on; and for the same row of pixels, the row of pixels receive the second scan signal when the corresponding shift register element outputs the drive signal, and receive the first scan signal when the preceding shift register element in the forward scan direction outputs the drive signal, that is, each row of pixels receive the second scan signal after the first scan signal is received, so that the display panel is scanned forward. Alike when the backward scan control line controls the backward scan switch transistors to be turned on, the respective shift register elements in the gate driver circuit output the drive signal sequentially in the backward scan direction, and the second control line controls the respective second switch transistors in the second control device to be turned on; and for the same row of pixels, the row of pixels receive the second scan signal when the corresponding shift register element outputs the drive signal, and receive the first scan signal when the preceding shift register element in the backward scan direction outputs the drive signal, that is, each row of pixels receive the second scan signal after the first scan signal is received, so that the display panel is scanned backward.

In one embodiment, in the scan circuit according to the embodiment of the disclosure, when the scan circuit includes the first switch transistors, both the first switch transistors and the forward scan switch transistors are N-type transistors or P-type transistors. The first control line and the forward scan control line are the same line. In this way, one control line can be dispensed with to narrow the bezel of the display panel in width.

In one embodiment, in the scan circuit according to the embodiment of the disclosure, when the scan circuit includes the second switch transistors, both the second switch transistors and the backward scan switch transistors are N-type transistors or P-type transistors. The second control line and the backward scan control line are the same line. In this way, one control line can be dispensed with to narrow the bezel of the display panel in width.

In one embodiment, in the scan circuit according to the embodiment of the disclosure, when the scan circuit includes the first signal terminal, the first signal terminal and the forward scan frame trigger terminal are the same terminal. In this way, one signal terminal can be dispensed with to simplify the structure of the scan circuit.

In one embodiment, in the scan circuit according to the embodiment of the disclosure, when the scan circuit includes the second signal terminal, the second signal terminal and the backward scan frame trigger terminal are the same terminal. In this way, one signal terminal can be dispensed with to simplify the structure of the scan circuit.

Figure 14:
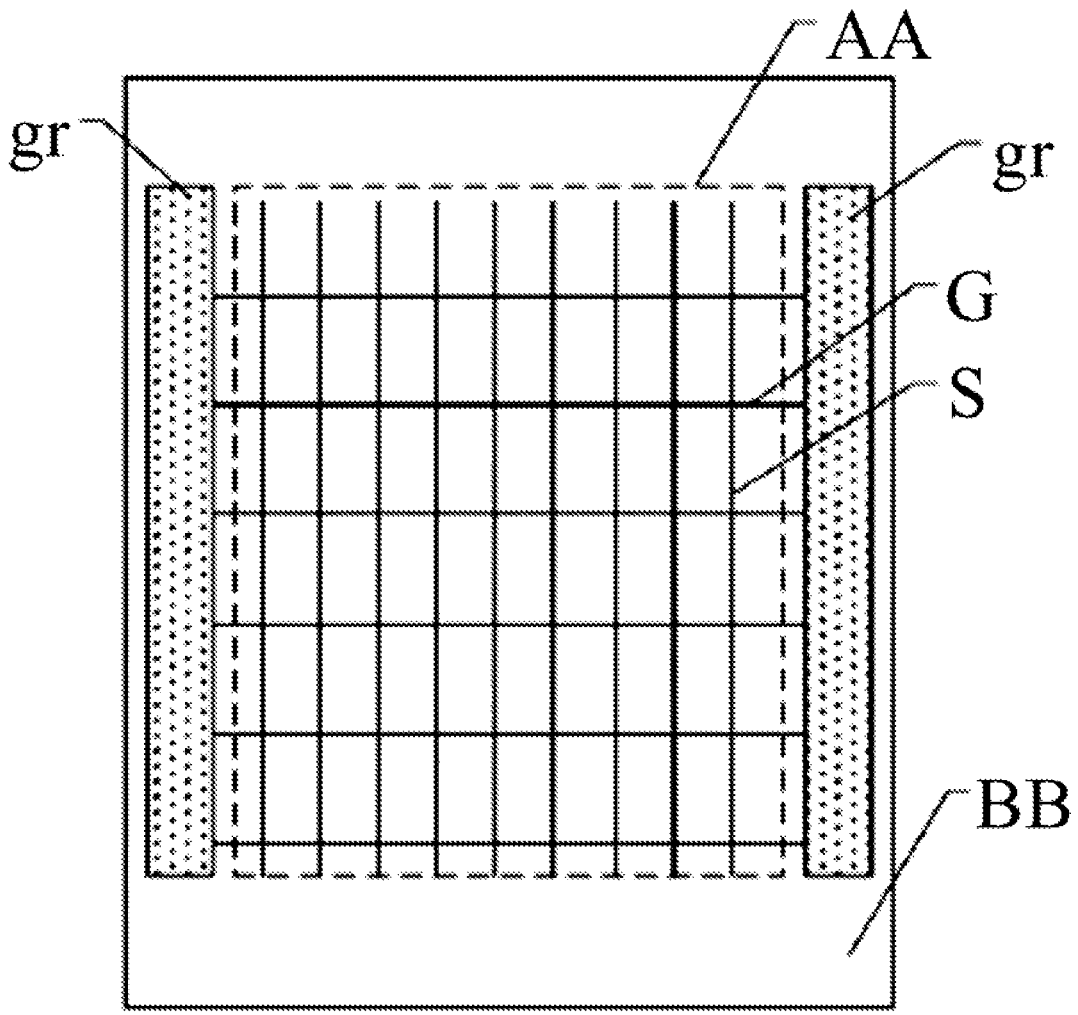
FIG. 14 is a schematic structural diagram of a display panel in accordance with an embodiment of the disclosure.
Figure 15:
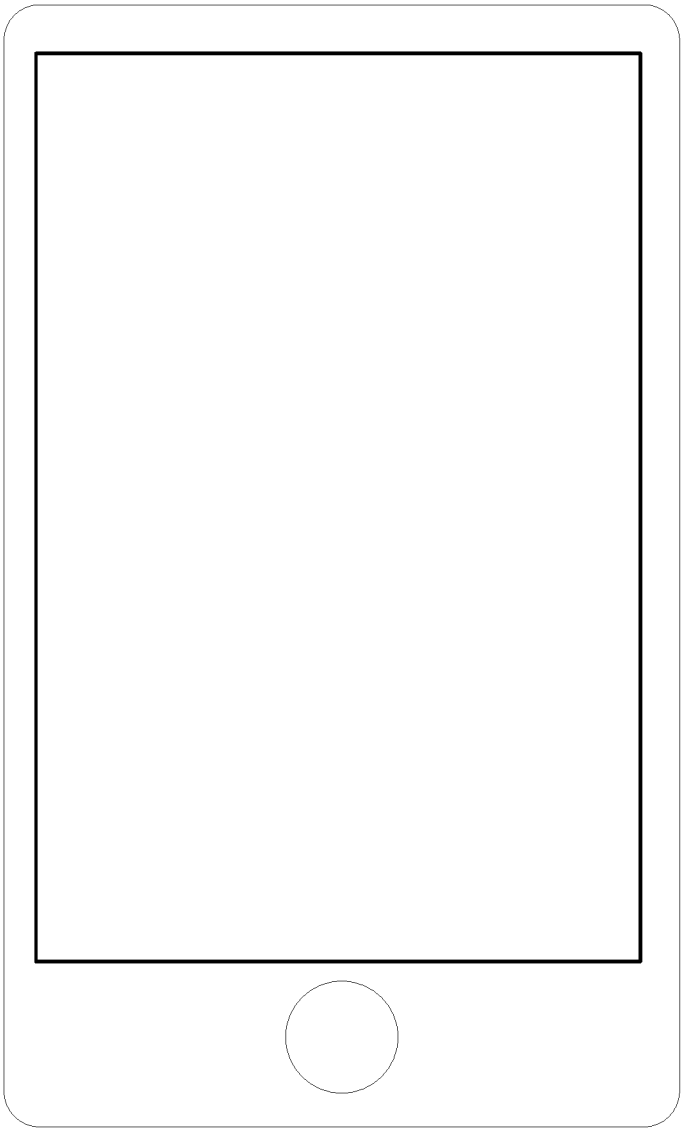
FIG. 15 is a schematic structural diagram of a display device in accordance with an embodiment of the disclosure.

Based upon the same inventive idea, an embodiment of the disclosure further provides a display panel including the scan circuits according to any one of the embodiments above of the disclosure. As illustrated in FIG. 14, the display panel includes a display area AA and a non-display area BB, where the display area AA includes gate lines G, and data lines S intersecting with and insulated from the gate lines G, and the non-display area BB includes the scan circuit gr according to any one of the embodiments above of the disclosure. Each signal output terminal in the scan circuit corresponds to two gate lines (each gate is connected with one row of pixels).

In a specific implementation, in the embodiment of the disclosure, the display panel can include two scan circuits. In one embodiment, as illustrated in FIG. 14, one of the signal output terminals in the respective scan circuits is connected with one of the gate lines in the display panel, and the signal output terminals in the same stage in these two scan circuits are connected with the same gate line.

In a specific implementation, the display panel can be an OLED display panel in which pixels are arranged in each row, each of the pixels includes an OLED and a pixel circuit configured to drive the OLED to emit light, and the scan circuit outputs the scan signal to the pixel circuit to control the pixel circuit.

Based upon the same inventive idea, an embodiment of the disclosure further provides a display device including the display panel above according to the embodiment of the disclosure. The display device according to this embodiment can be an array substrate, or can be a terminal display device, e.g., a phone, a computer, a TV set, or another display device with a display function, although the embodiment of the disclosure will not be limited thereto. The display device according to the embodiment of the disclosure has the advantageous effects of the scan circuit according to the embodiments of the disclosure, and reference can be made to the respective embodiments above. A repeated description of the scan circuit will be omitted here in this embodiment.

In the scan circuit, the display panel, and the display device above according to the embodiments of the disclosure, the scan circuit includes the switch control circuit in addition to the gate driver circuit with the forward and backward scan functions. The switch control circuit is configured to transmit the second scan signal to the corresponding row of pixels, and the first scan signal to its next row of pixels in the scan direction respectively when the drive signal is output at each of the signal output terminals of the gate driver circuit. In this way, no matter whether the gate driver circuit performs forward or backward scanning, the switch control circuit transmits firstly the first scan signal and then the second scan signal, that is, the row of pixels receives the first scan signal and the second scan signal at the fixed timing, so the same function can be performed for the row of pixels in both the forward scan direction and the backward scan direction. Accordingly in the embodiment of the disclosure, the scan circuit can be arranged to functionally perform bidirectional scanning on the display panel.

What is claimed is:

1. A scan circuit, comprising:

a switch control circuit, and a gate driver circuit with forward and backward scan functions, wherein:

the gate driver circuit comprises a plurality of signal output terminals, wherein each of the signal output terminals corresponds to one row of a plurality of rows of pixels, and the gate driver circuit is configured to output a drive signal sequentially through the plurality of signal output terminals; and the switch control circuit is configured to transmit a second scan signal to a corresponding row of pixels, and a first scan signal to its next row of pixels in a scan direction when the gate driver circuit outputs the drive signal at each of the signal output terminals;

wherein the switch control circuit is further configured to transmit the first scan signal to a first row of pixels in the scan direction before the second scan signal is transmitted thereto.

2. The scan circuit according to claim 1, wherein for a same row of pixels, the switch control circuit is configured to transmit the first scan signal to the row of pixels before the second scan signal is transmitted thereto, wherein the first scan signal is configured to initialize the row of pixels, and the second scan signal is configured to compensate for the row of pixels.

3. The scan circuit according to claim 1, wherein the row of pixels comprises a first control terminal configured to receive the first scan signal, and a second control terminal configured to receive the second scan signal;

the switch control circuit comprises a first switch control sub-circuit, a second switch control sub-circuit, and N wire lines, wherein N is the number of rows of pixels; and each of the wire lines corresponds to one of the signal output terminals and each of the signal output terminals is connected with the second control terminal of a corresponding row of pixels through the corresponding wire line;

the first switch control sub-circuit comprises: a first control device, a first control line, and a first signal terminal, wherein the first control device is connected respectively with the first control line, the first signal terminal, the signal output terminals, and the first control terminals of the rows of pixels; and the first control device is configured to connect the first control terminal of the first row of pixels in a forward scan direction with the first signal terminal, and to connect the first control terminals of the other rows of pixels than the first row of pixels in the forward scan direction with their corresponding preceding signal output terminals, under the control of the first control line; and the second switch control circuit comprises: a second control device, a second control line, and a second signal terminal, wherein the second control device is connected respectively with the second control line, the second signal terminal, the signal output terminals, and the first control terminals of the rows of pixels, wherein the second control device is configured to connect the first control terminal of the first row of pixels in a backward scan direction with the second signal terminal, and to connect the first control terminals of the other rows of pixels than the first row of pixels in the backward scan direction with their corresponding preceding signal output terminals, under the control of the second control line.

4. The scan circuit according to claim 3, wherein the first control device comprises N first switch transistors, wherein a n-th one of the first switch transistors corresponds to a n-th row of pixels in the forward scan direction, wherein n is any integer from 1 to N;

a first one of the first switch transistors has a first electrode connected with the first signal terminal, and the others of the first switch transistors than the first one have first electrodes connected with their corresponding preceding signal output terminals in the forward scan direction; and each of the first switch transistors has a gate connected with the first control line, and a second electrode connected with the second control terminal of its corresponding row of pixels.

5. The scan circuit according to claim 3, wherein the second control device comprises N second switch transistors, wherein a n-th one of the second switch transistors corresponds to a n-th row of pixels in the backward scan direction;

a first one of the second switch transistors has a first electrode connected with the second signal terminal, and the others of the second switch transistors than the first one have first electrodes connected with their preceding signal output terminals in the backward scan direction; and each of the second switch transistors has a gate connected with the second control line, and a second electrode connected with the second control terminal of its corresponding row of pixels.

6. The scan circuit according to claim 5, wherein both the first switch transistors and the second switch transistors are N-type transistors, or both the first switch transistors and the second switch transistors are P-type transistors.

7. The scan circuit according to claim 5, wherein the first switch transistors are N-type transistors, and the second switch transistors are P-type transistors; or wherein the first switch transistors are P-type transistors, and the second switch transistors are N-type transistors.

8. The scan circuit according to claim 7, wherein the first control line and the second control line are a same signal line.

9. The scan circuit according to claim 1, wherein the switch control circuit is further configured to output a third scan signal to an after next row of pixels in the scan direction when the gate driver circuit outputs the drive signal at each of the signal output terminals; and for a same row of pixels, the switch control circuit is configured to transmit the first scan signal to the row of pixels before the second scan signal is transmitted thereto, and to transmit the third scan signal to the row of pixels before the first scan signal is transmitted thereto.

10. The scan circuit according to claim 9, wherein the switch control circuit is further configured to transmit a (n+1)-th scan signal to a n-th row of pixels succeeding to a corresponding row of pixels in the scan direction when the gate driver circuit outputs the drive signal at each of the signal output terminals, wherein n is a positive integer equal to or more than 3; and for a same row of pixels, the switch control circuit is configured to transmit the n-th scan signal to the row of pixel before the (n+1)-th scan signal is transmitted thereto.

11. The scan circuit according to claim 1, wherein the gate driver circuit comprises a plurality of cascaded shift register elements, each of which corresponds to one of the signal output terminals, wherein:

a forward input terminal of a first-stage shift register element in the forward scan direction is connected with a forward scan frame trigger terminal, and a forward input terminal of the other-stage shift register element than the first-stage shift register element is connected with the signal output terminal corresponding to its preceding stage shift register element in the forward scan direction; and a backward input terminal of a last-stage shift register element in the forward scan direction is connected with a backward scan frame trigger terminal, and a backward input terminal of the other-stage shift register element than the last-stage shift register element is connected with the signal output terminal corresponding to its preceding stage shift register element in the backward scan direction.

12. The scan circuit according to claim 11, wherein the gate driver circuit further comprises a forward scan control circuit and a backward scan control circuit, wherein:

the forward scan control circuit comprises forward scan switch transistors and a forward scan control line, wherein the forward scan switch transistors are configured to control each the shift register elements to output the drive signal sequentially in the forward scan direction, under the control of the forward scan control line; and the backward scan control circuit comprises backward scan switch transistors and a backward scan control line, wherein the backward scan switch transistors are configured to control the shift register elements to output the drive signal sequentially in the backward scan direction, under the control of the backward scan control line.

13. The scan circuit according to claim 12, wherein when the scan circuit comprises first switch transistors, both the first switch transistors and the forward scan switch transistors are N-type transistors or P-type transistors; and the first control line and the forward scan control line are the same signal line.

14. The scan circuit according to claim 12, wherein when the scan circuit comprises the second switch transistors, both the second switch transistors and the backward scan switch transistors are N-type transistors or P-type transistors; and the second control line and the backward scan control line are the same signal line.

15. The scan circuit according to claim 11, wherein when the scan circuit comprises a first signal terminal, the first signal terminal and the forward scan frame trigger terminal are the same terminal.

16. The scan circuit according to claim 11, wherein when the scan circuit comprises a second signal terminal, the second signal terminal and the backward scan frame trigger terminal are the same terminal.

17. A display panel, comprising:

a scan circuit, wherein the scan circuit comprises:

a switch control circuit, and a gate driver circuit with forward and backward scan functions, wherein:

the gate driver circuit comprises a plurality of signal output terminals, wherein each of the signal output terminals corresponds to one row of a plurality of rows of pixels, and the gate driver circuit is configured to output a drive signal sequentially through the plurality of signal output terminals; and the switch control circuit is configured to transmit a second scan signal to a corresponding row of pixels, and a first scan signal to its next row of pixels in a scan direction when the gate driver circuit outputs the drive signal at each of the signal output terminals;

wherein the switch control circuit is further configured to transmit the first scan signal to a first row of pixels in the scan direction before the second scan signal is transmitted thereto.

18. A display device, comprising:

a display panel, wherein the display panel comprises a scan circuit, the scan circuit comprising:

a switch control circuit, and a gate driver circuit with forward and backward scan functions, wherein:

the gate driver circuit comprises a plurality of signal output terminals, wherein each of the signal output terminals corresponds to one row of a plurality of rows of pixels, and the gate driver circuit is configured to output a drive signal sequentially through the plurality of signal output terminals; and the switch control circuit is configured to transmit a second scan signal to a corresponding row of pixels, and a first scan signal to its next row of pixels in a scan direction when the gate driver circuit outputs the drive signal at each of the signal output terminals;

wherein the switch control circuit is further configured to transmit the first scan signal to a first row of pixels in the scan direction before the second scan signal is transmitted thereto.

* * * * *